US006688880B1

(12) United States Patent
Pangle

(10) Patent No.: US 6,688,880 B1
(45) Date of Patent: Feb. 10, 2004

(54) CANDLE WICK EXTENDER

(76) Inventor: Randy Lee Pangle, P.O. Box 2776, Carefree, AZ (US) 85377

( * ) Notice: Subject to any disclaimer, the term of this patent is extended or adjusted under 35 U.S.C. 154(b) by 0 days.

(21) Appl. No.: 10/202,763

(22) Filed: Jul. 25, 2002

(51) Int. Cl.[7] ..... F23D 3/16; F23D 3/18
(52) U.S. Cl. ..... 431/289; 431/325; 431/290
(58) Field of Search ..... 431/289, 290, 431/298, 288, 325, 345

(56) References Cited

U.S. PATENT DOCUMENTS

| | | | | | |
|---|---|---|---|---|---|
| 816,790 | A | * | 4/1906 | Genovese et al. | 431/289 |
| 1,505,092 | A | * | 8/1924 | Grupe | 431/289 |
| 2,189,412 | A | * | 2/1940 | Arnone | 431/325 |
| 2,246,346 | A | * | 6/1941 | Carroll | 431/298 |
| 3,428,409 | A | * | 2/1969 | Summers | 431/289 |
| 3,462,235 | A | * | 8/1969 | Summers | 431/289 |
| 3,466,135 | A | * | 9/1969 | Summers | 431/289 |
| 4,424,018 | A | * | 1/1984 | Lowther, Sr. | 431/288 |
| 4,790,747 | A | | 12/1988 | O'Brien | |
| 6,270,340 | B1 | | 8/2001 | Lepp | |

FOREIGN PATENT DOCUMENTS

| | | | |
|---|---|---|---|
| DE | 3504911 | * | 3/1986 |
| FR | 2283217 | * | 4/1976 |

* cited by examiner

*Primary Examiner*—Alfred Basichas
(74) *Attorney, Agent, or Firm*—Donald J. Lenkszus

(57) ABSTRACT

A wick extender is provided that may be used with candles that have such short wicks that the candles are not easily lightable. The wick extender includes a wick affixed to a rigid support member.

11 Claims, 1 Drawing Sheet

CANDLE WICK EXTENDER

FIELD OF INVENTION

This invention relates to candles, in general, and to wicks which are placed on a candle to extend the use of candles when the candle's existing wick is too short, in particular.

BACKGROUND OF THE INVENTION

For centuries, candles have been used to provide a flame that emanates light. In recent times, candles are utilized not for primary lighting, but for artistic, aesthetic, and mood setting purposes. In many instances, the candles also provide pleasing aromas. In other applications, the candles are utilized to vaporize insect repellents.

Typically, present-day candles utilize one or more wicks generally situated in the center of the candle. Once ignited, the wick or wicks begins to burn and to heat the wax that surrounds the wick, which forms a molten wax pool. As the wax proximate to the wick melts, it is absorbed by the wick, and is drawn by capillary action into the flame where it is vaporized and burned into constituent combustion products. As the wax in the wick proximate to the flame burns away, more wax is drawn into the wick and up to the flame. As wax from the molten pool surrounding the wick is burned off, the flame moves down the wick. As the flame moves down the wick, it melts the surrounding wax, which flows into the molten pool. This process continues, and over time, in candles that have a large enough outside diameter, a recess develops within a wall, in the case of a single wick candle, or walls, in the case of multi-wick candles, that are formed by the portion of the candle that is not burned away by the flame. In turn, the level of the molten pool of wax moves lower into the recess that forms within the candle. The recess that forms within the candle and which is surrounded by the remaining walls is termed the primary well.

Ideally, when candles are extinguished and re-ignited, they are left to burn for a period of time that is long enough so that a single well forms within the candle well or chimney. In less than ideal situations, and as is often the case with large diameter candle products, the candle is extinguished, re-ignited, and re-extinguished without regard to whether it has burned for the proper period of time so that only the single, primary well develops.

When a flame on an ignited wick is smothered, the wick may drown itself in the candle wax that has melted around it while the wick was lit. The next time the candle is to be used, the molten candle wax will have hardened over the wick and in order to use the candle, the wick will have to be found and "dug out" of the hardened wax. Another problem that may arise after an ignited wick is smothered is that the wick may continue to burn down into the candle wax such that the end of the wick will be deep within the candle wax and not be able to be lit the next time the candle is to be used. A much more general problem inherent in most candles is that a wick will burn to the bottom or along one side of the candle such that approximately eighty percent (80%) of the candle wax has not melted. The remaining wax cannot be used since there is no longer a wick to burn it.

SUMMARY OF THE INVENTION

In accordance with the principles of the invention, a wick extender for use with a candle having a wick that terminates at or proximate the top surface of the candle wax is provided. A wick extender in accordance with the invention comprises a rigid support and a wick. The support member and the wick are affixed to each other. The support member is insertable into a candle proximate the candle's wick and supports the wick proximate to said candle wick to effectively extend the length of the candle wick.

In accordance with one aspect of the invention, the support is threaded through a portion of said wick. A wax layer affixes said wick to said support.

In accordance with one aspect of the invention, the support member comprises a combustible material that does not produce toxic by-products when heated or burned.

In one embodiment of the invention, the combustible material comprises wood.

In another embodiment of the invention, the support member comprises metal. The metal support member may be in an inverted U-shape.

In accordance with other aspects of the invention, the wick includes a first portion extending above the support member, and the support member includes a portion extending below the wick for insertion into a candle.

BRIEF DESCRIPTION OF THE DRAWING

The invention will be better understood from a reading of the following detailed description of embodiments of the invention taken in conjunction with the drawing figures in which like reference designations are utilized to identify like elements, and in which.

DETAILED DESCRIPTION

Figure 2:
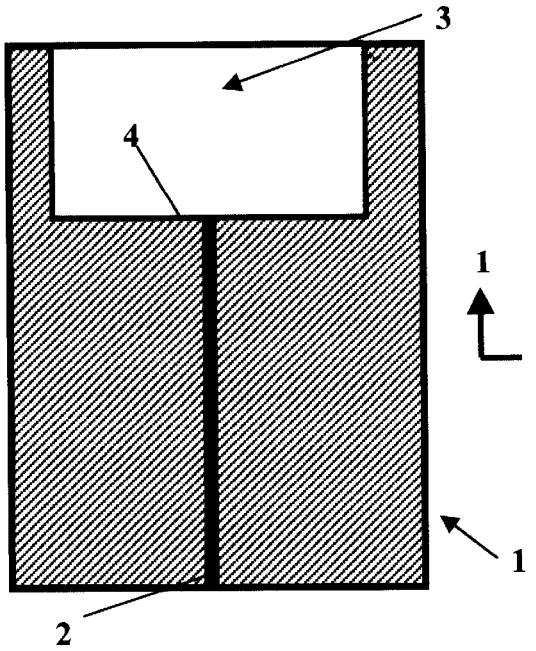
FIG. 2 is cross section of the candle of FIG. 1, taken along lines 1—1.
Figure 1:
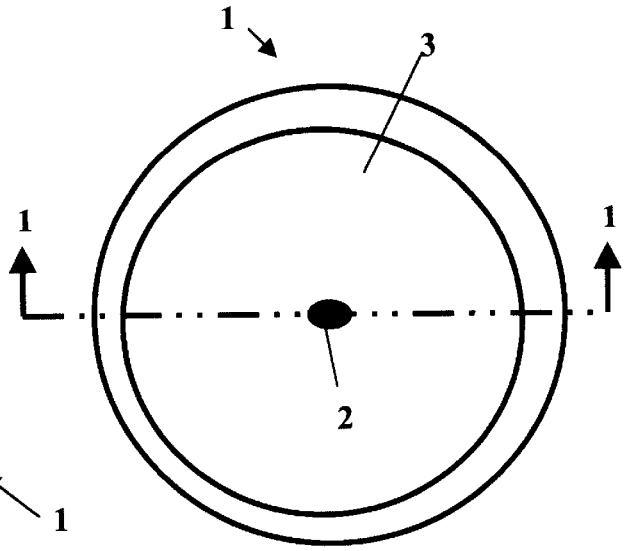
FIG. 1 is a top view of a prior art candle to which the invention may be advantageously applied.

Turning now to FIGS. 1 and 2, a representative candle 1 is shown to which the devices of the invention may be advantageously applied. Candle 1 includes a wick 2. Candle 1 has been used and a recess or well 3 has been formed in candle 1. Wick 2 for any one of a number of reasons terminates at or just below the wax surface 4 of recess or well 3. With wick 2 so positioned, it is impossible to light candle 1 without digging out the area around wick 2.

Figure 3:
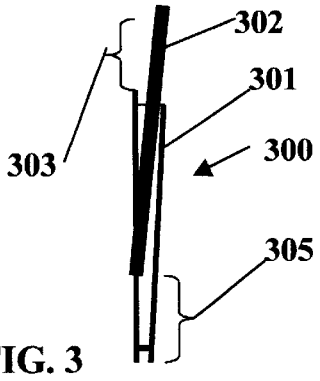
FIG. 3 is a device in accordance with the principles of the invention.

FIG. 3 illustrates a first wick extender 300 in accordance with the principles of the invention. Wick extender 300 includes a support member 301 which carries a wick 302. Wick 302 is a wax coated wick of the same type utilized in candles. Support member 301 is threaded through wick 302 and further secured to support member 301 by a wax coating. Support member 301 in the preferred embodiment is made of wood and to assure that burning of the wick extender does not introduce any toxicity into the environment. Support member 301 is in the general shape of one half of a toothpick. Wick 302 includes a portion 303 that extends above support member 301. Wick support member 301 includes a portion 305 that extends below wick 302. In the illustrative embodiment, the top portions 303 is approximately ½ inch, as is the length of portion 305.

To utilize wick extender 300 in a candle such as shown in FIGS. 1 and 2, wick extender 300 is pressed into candle 1.

Figure 4:
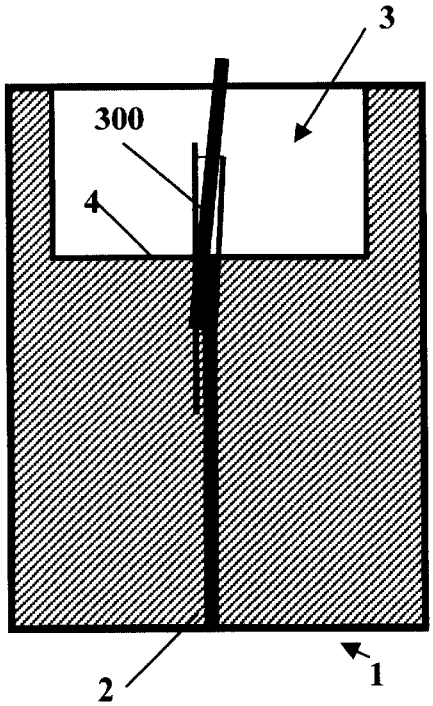
FIG. 4 illustrates a candle taken in cross-section and into which the device of FIG. 3 is inserted.

Support member 301 is rigid enough so that it will press into the wax of candle 1. Support member 301 is inserted into candle 1 such that wick 302 is proximate wick 2 of candle 1, as shown in FIG. 4. As wick 302 is burned, it acts as an extension of wick 2 such that as wax is consumed, eventually wick 2 will be exposed to a length that will permit candle 1 to be snuffed out and relit. It should be noted that wick extender 300 is shown with a portion of wick 302 below surface 4 of candle 1. The positioning of wick extender 300 is not critical so long as wick 302 is at or below surface 4 and is proximate wick 2.

Figure 5:
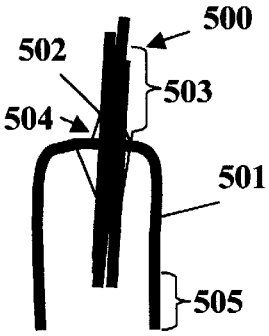
FIGS. 5 and 6 illustrate a second device in accordance with the principles of the invention.
Figure 6:
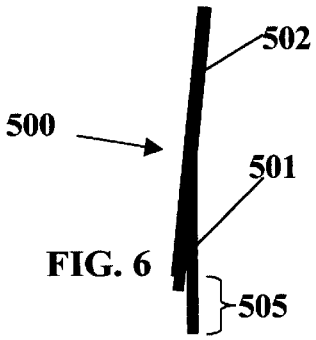

FIGS. 5 and 6 show another embodiment of the invention. Wick extender 500 includes a support member 501 which carries a wick 502. Wick 502 is a wax coated wick of the same type utilized in candles. Support member 501 is threaded through wick 502. Wick 502 is affixed to support member 501 by a wax coating 504. Support member 501 in the preferred embodiment is made of metal wire that is sufficiently rigid to be inserted into the wax of candle 1. The metal is selected to assure that heat produced by burning of wick 502 or candle wick 2 does not introduce any toxicity into the environment. Support member 501 is in the general shape of an inverted "U". Wick 502 includes a portion 503 that extends above support member 501. Wick support member 501 includes a portion 505 that extends below wick 502.

To utilize wick extender 500 in a candle such as shown in FIGS. 1 and 2, wick extender 500 is pressed into candle 1 in the same manner as wick extender 300 is inserted into candle 1. Support member 501 is rigid enough so that it will press into the wax of candle 1. Support member 501 is inserted into candle 1 such that wick 502 is proximate wick 2 of candle 1. As wick 502 is burned, it acts as an extension of wick 2 such that as wax is consumed, eventually wick 2 will be exposed to a length that will permit candle 1 to be snuffed out and relit.

Although the invention has been shown and described in terms of two embodiments, it will be understood by those skilled in the art that various modifications may be made to the embodiments without departing from the spirit or scope of the invention. Different materials may be substituted for those employed in the illustrative embodiments, for example. In addition, other support shapes may be substituted for the U-shape shown. For example, a straight rigid wire may be utilized.

It is not intended that the invention be limited in scope to only the embodiments shown. It is intended that the invention be limited in scope only by the scope of the claims appended hereto.

What is claimed is:

1. A candle wick extender, for use with a candle having a candle wick that terminates at or proximate a top surface of the candle's wax, comprising:

a rigid, solid and non-hollow support member;

an extension wick;

said support member having a first elongate portion being adapted to being inserted longitudinally into the top surface of a candle proximate to a candle wick that terminates proximate the top surface of the candle, said first elongate portion being disposed substantially parallel to the axis of the candle wick and substantially perpendicular to the top surface of the candle, said support member having a second clongate portion, said second elongate portion extending above the top surface of the candle;

said support member second clongate portion having said extension wick affixed thereto, said extension wick being supported on the outside surface of said support member second portion, said extension wick being supported on said support member second portion such that said extension wick is disposed substantially perpendicular to said candle top surface when said first portion is inserted into said candle and said wick extension extending above the top surface of the candle proximate the candle wick.

2. The candle wick extender in accordance with claim 1, wherein:

said support member comprises a combustible material.

3. The candle wick extender in accordance with claim 1, wherein:

said combustible material does not produce toxic by-products when heated or burned.

4. The candle wick extender in accordance with claim 2, wherein:

said combustible material comprises wood.

5. The candle wick extender in accordance with claim 1, wherein:

said support member does not produce toxic by-products when heated.

6. The candle wick extender in accordance with claim 1, wherein:

said support member comprises metal.

7. The candle wick extender in accordance with claim 6, wherein:

said support member is in an inverted U-shape.

8. The candle wick extender in accordance with claim 1, wherein:

said support member is a stake.

9. The candle wick extender in accordance with claim 1, wherein:

said support member is threaded through a portion of said extension wick.

10. The candle wick extender in accordance with claim 9, comprising:

wax affixing said extension wick to said support member.

11. The candle wick extender in accordance with claim 1, comprising:

wax affixing said extension wick to said support member.

* * * * *